US006698976B1

(12) United States Patent
Cho

(10) Patent No.: US 6,698,976 B1
(45) Date of Patent: Mar. 2, 2004

(54) GROUTING PIPE EQUIPMENT AND METHOD OF GROUTING USING THE SAME FOR AN UNDERGROUND WATER WELL

(75) Inventor: Heuy Nam Cho, Songnam-shi (KR)

(73) Assignee: Songdo Technopark, Inchon (KR)

( * ) Notice: Subject to any disclaimer, the term of this patent is extended or adjusted under 35 U.S.C. 154(b) by 0 days.

(21) Appl. No.: 09/763,259

(22) PCT Filed: Aug. 18, 1999

(86) PCT No.: PCT/KR99/00458

§ 371 (c)(1),
(2), (4) Date: Apr. 16, 2001

(87) PCT Pub. No.: WO00/11312

PCT Pub. Date: Mar. 2, 2000

(30) Foreign Application Priority Data

| | | |
|---|---|---|
| Aug. 19, 1998 | (KR) | 98-33646 |
| Oct. 30, 1998 | (KR) | 98-20870 U |
| May 11, 1999 | (KR) | 20-1999-7981 |
| Jun. 21, 1999 | (KR) | 20-1999-11506 |
| Jun. 25, 1999 | (KR) | 20-1999-11547 |

(51) Int. Cl.[7] ..... B65G 5/00; E21B 23/00; F16L 51/02

(52) U.S. Cl. ..... 405/53; 405/55; 405/225; 405/248; 166/187; 175/57; 175/99; 285/226

(58) Field of Search ..... 405/225, 53, 232, 405/55, 233, 236–243, 244, 248, 135, 147, 152; 166/185–187, 285, 287; 175/57, 99; 285/226–228

(56) References Cited

U.S. PATENT DOCUMENTS

| | | | | | |
|---|---|---|---|---|---|
| 3,593,797 | A | * | 7/1971 | Lebourg | 166/290 |
| 3,946,761 | A | * | 3/1976 | Thompson et al. | 138/98 |
| 4,077,224 | A | * | 3/1978 | Coone | 405/225 |
| 4,171,923 | A | * | 10/1979 | Landers | 405/225 |
| 4,279,546 | A | * | 7/1981 | Landers | 405/225 |
| 4,402,551 | A | | 9/1983 | Wood et al. | 299/5 |
| 4,819,970 | A | * | 4/1989 | Umehara | 285/227 |
| 4,838,079 | A | * | 6/1989 | Harris | 166/127 |
| 4,902,170 | A | * | 2/1990 | Knox et al. | 405/225 |
| 4,909,323 | A | | 3/1990 | Hastings | 166/242 |
| 4,948,301 | A | * | 8/1990 | Geffriaud et al. | 405/244 |
| 4,968,184 | A | * | 11/1990 | Reid | 405/225 |
| 5,269,570 | A | * | 12/1993 | Nunley | 285/229 |
| 5,287,741 | A | * | 2/1994 | Schultz et al. | 166/298 |
| 5,287,893 | A | * | 2/1994 | Elgar et al. | 138/98 |
| 5,332,037 | A | | 7/1994 | Schmidt et al. | 166/276 |
| 5,358,048 | A | * | 10/1994 | Brooks | 166/285 |
| 5,443,124 | A | * | 8/1995 | Wood et al. | 166/374 |
| 5,791,378 | A | | 8/1998 | Stephens | 138/98 |
| 5,899,268 | A | * | 5/1999 | Lynde et al. | 166/55.6 |
| 6,098,710 | A | * | 8/2000 | Rhein-Knudsen et al. | 166/285 |
| 6,125,929 | A | * | 10/2000 | Davis et al. | 166/55.7 |
| 6,148,912 | A | * | 11/2000 | Ward | 166/250.07 |
| 6,296,056 | B1 | * | 10/2001 | Ward | 166/250.07 |

FOREIGN PATENT DOCUMENTS

| | | | | |
|---|---|---|---|---|
| EP | 0 846 839 A2 | | 6/1998 | |
| JP | 61211416 | * | 9/1986 | 405/36 |

OTHER PUBLICATIONS

Intl Search Rep., Aug. 18, 1999, PCT.

* cited by examiner

*Primary Examiner*—Jong-Suk (James) Lee
(74) *Attorney, Agent, or Firm*—Howrey Simon Arnold & White, LLP

(57) ABSTRACT

Grouting equipment and methods suitable for use in underground water wells, which accomplish their goals by better centering the grouting equipment within a bore hole, even in curved bore holes, in an manner that prevents leakage of the grout into the well. Improved grouting is achieved by using corrugated, bendable incasings and expandable tubes which create a seal between the incasing and the well wall for the grout, and which prevent both contaminated surface water and grout from contaminating the groundwater. The disclosed techniques are implementable in such a manner that grouting does not necessarily need to precede the location of a groundwater nappe.

30 Claims, 19 Drawing Sheets

GROUTING PIPE EQUIPMENT AND METHOD OF GROUTING USING THE SAME FOR AN UNDERGROUND WATER WELL

This application is a national stage filing of international application PCT/KR99/00458, filed Aug. 18, 1999, which claims priority to the following Korean Patent Application Numbers: 1998/33646, filed Aug. 19, 1998, 1998/20870U, filed Oct. 30, 1998, 1999/7981U, filed May 11, 1999, 1999/11506U, filed Jun. 21, 1999, and 1999/11547U, filed Jun. 25, 1999. Priority is claimed to all of these prior applications.

FIELD OF THE INVENTION

The present invention relates to grouting pipe equipment for underground water wells and grouting method wherein concrete is cured on the interior wall of a bore hole in order to prevent contaminated surface water and the like from flowing in the water well.

BACKGROUND ART

A conventional arrangement for the extraction of groundwater is illustrated in FIG. 1. This arrangement includes:

- an outcasing 1, which is installed to prevent the stratum of weathered rock from collapsing into the well. The outcasing 1 is installed following the drilling of the earth from the surface to a bedrock layer with a well drilling machine;
- an incasing 3, which is installed to prevent an inflow of surface water. The incasing 3 is installed after installation of the outcasing 1 and subsequent to further drilling of the bedrock layer until a nappe of groundwater is reached;
- a strainer pipe 18, which is installed at a position beneath the incasing 3, to allow an influx of groundwater while preventing influx of soil, sand, or other foreign substances;
- concrete (not shown), which is injected and cured into the space formed between the incasing 3 and the wall of the water well, to further prevent influx of soil, sand, or other foreign substances;
- a water pump 20, which is installed inside the incasing 3;
- a water-lifting pipe 22, which is connected to the water pump 20 to lift the groundwater out of the well, and which further includes an upper level sensor 53 and a lower level sensor 54 which enable groundwater to be extracted from the well when the groundwater table is at levels predetermined by the sensors;
- a water gauge pole (34), which allows the water table in the well to be monitored at certain depths.

In this conventional arrangement, often the outcasing 1 is too shallow, ending for example at around the middle of the weathered rock layer, when it should be embedded into the bedrock layer. Indeed, sometimes bores have been intentionally formed on the outcasing to allow surface water to flow into the well. Furthermore, synthetic resin incasings are sometimes not installed in a given water well, or if installed, are not grouted. Accordingly, prior art approaches have allowed polluted surface water to flow into groundwater water wells, resulting in pollution of those wells.

Of the above scenarios, a most common problem is the insertion of an incasing without the use of a subsequent grouting process. This often occurred because it was essentially impossible to restrict the depth of the insertion of the incasing, and hence the depth of the concrete.

In another conventional technique for preventing permeation of surface water, a bore hole is drilled to the surface of a bedrock layer, and an outcasing is installed. Thereafter, concrete is injected and cured inside of the outcasing, and then further excavation is performed until a nappe of groundwater is reached, thus forming another bore hole of a smaller diameter to accommodate an incasing. However, this method is inefficient because the grouting process must be performed without knowing the quantity, if any, of the groundwater available at the well site. In other words, the possibility is raised that the well would need to be abandoned as unsuccessful after the expensive process of grouting has been performed.

To solve this particular problem alternative methods have been implemented. Specifically, it has been attempted to drill to the upper layer of a bedrock stratum to insert an outcasing. Then, to accommodate the subsequent placement of an incasing, the drilling bit has been changed to a smaller diameter to allow drilling to continue until a nappe of groundwater is reached. Thereafter, concrete is grouted into the annular space between the incasing and the interior wall of the drilled bore hole to prevent influx of surface water.

This method however is problematic because it is difficult to grout the concrete in the lower portions of the well. Moreover, even if it is possible to grout the lower portions, the groundwater will be contaminated by leakage of the concrete into the well. Furthermore, because the annular space that the concrete fills is typically narrow, for example, about 50–60 mm in width, the concrete may "bridge" at some intermediate point in the space and prevent the space from being fully grouted when concrete is introduced from the top of the well. Additionally, if the water table has already risen in the well, the concrete would be diluted by blending with the groundwater present in the annular space, rendering it impossible to cure the concrete to a sufficient strength. To ensure water quality, the grouting process would therefore have to be implemented repeatedly, for example, twice or thrice, resulting in enormous additional construction expenses.

Another alternative approach used in the art has been to drill into the bedrock layer, confirm the presence of groundwater, and then to fill the well with sand from the depth of the nappe to a certain height within the well. Thereafter, lumps of clay or wooden boards are placed on the sand to seal the groundwater, and concrete is then grouted. Excavation can then be continued by removing and discharging the clay, the wooden boards, and the sand until the water is again reached, and then an incasing is inserted.

This approach too suffers from problems. If the central axis of the incasing does not coincide with the shaft of the pre-drilled bore hole, it will be impossible to use. Furthermore, if the sealing materials do not adequately seal of the groundwater, concrete may be injected even into the nappe, and may even cut the nappe off. Hence, the quality and quantity of attainable water is considerably decreased.

In addition to these problems encountered in the prior art, conventional methods suffer from the fact that when a bore hole is drilled, the bore hole may be curved to some extent because of the different constituents of the bedrock layer. In other words, the central axis of the bore hole will not be straight, making insertion of the incasing difficult or impossible, thus resulting in inferior grouting. Additionally, the concrete in conventional methods may infiltrate the nappe, thus either contaminating the water or reducing its quantity. This results because the dependability of the cutoff or sealing means cannot be adequately secured to protect the nappe from the concrete.

Also, these prior art approaches generally contemplate use with wells of larger diameters, and are therefore of limited utility in making underground water wells to service individual houses in rural villages, farms, and other small-scale constructions, which generally are less than 50 mm in diameter. The problems of the prior art are exacerbated for wells of such small sizes.

SUMMARY OF THE INVENTION

The disclosed embodiments of the invention provide grouting pipe equipment and easy and efficient grouting methods suitable for use in underground water wells. The various embodiments accomplish this result by better centering the grouting equipment within a bore hole, even in curved bore holes, in an manner that prevents leakage of the grout into the well. Improved grouting is achieved by using corrugated, bendable incasings and expandable tubes which create a seal between the incasing and the well wall for the grout, and which prevent both contaminated surface water and grout from contaminating the groundwater. The disclosed techniques are implementable in such a manner that grouting does not necessarily need to precede the location of a groundwater nappe.

DETAILED DESCRIPTION OF THE PREFERRED EMBODIMENTS

A. First Embodiment

Figure 1:
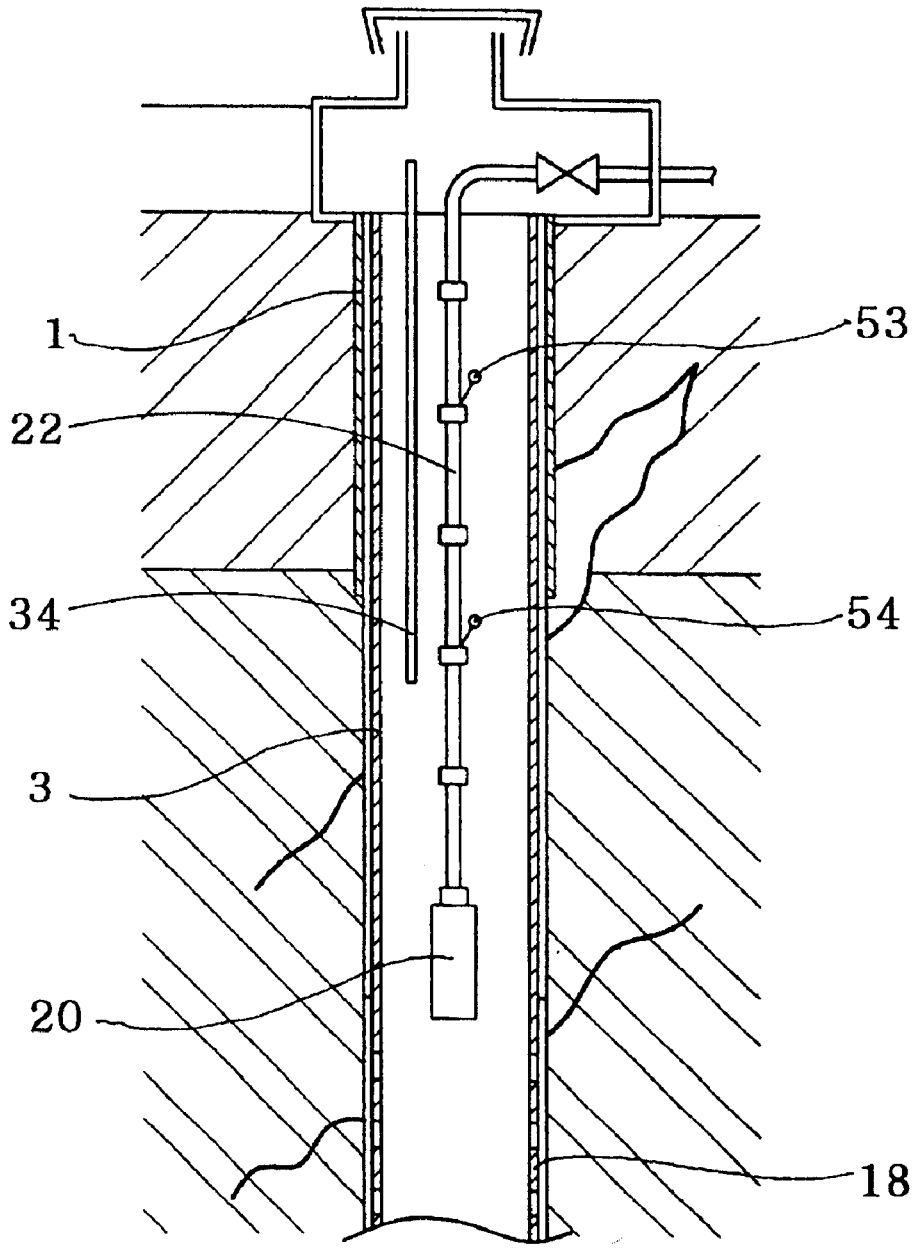
FIG. 1 is a cross-sectional view of conventional groundwater extraction equipment.
Figure 2:
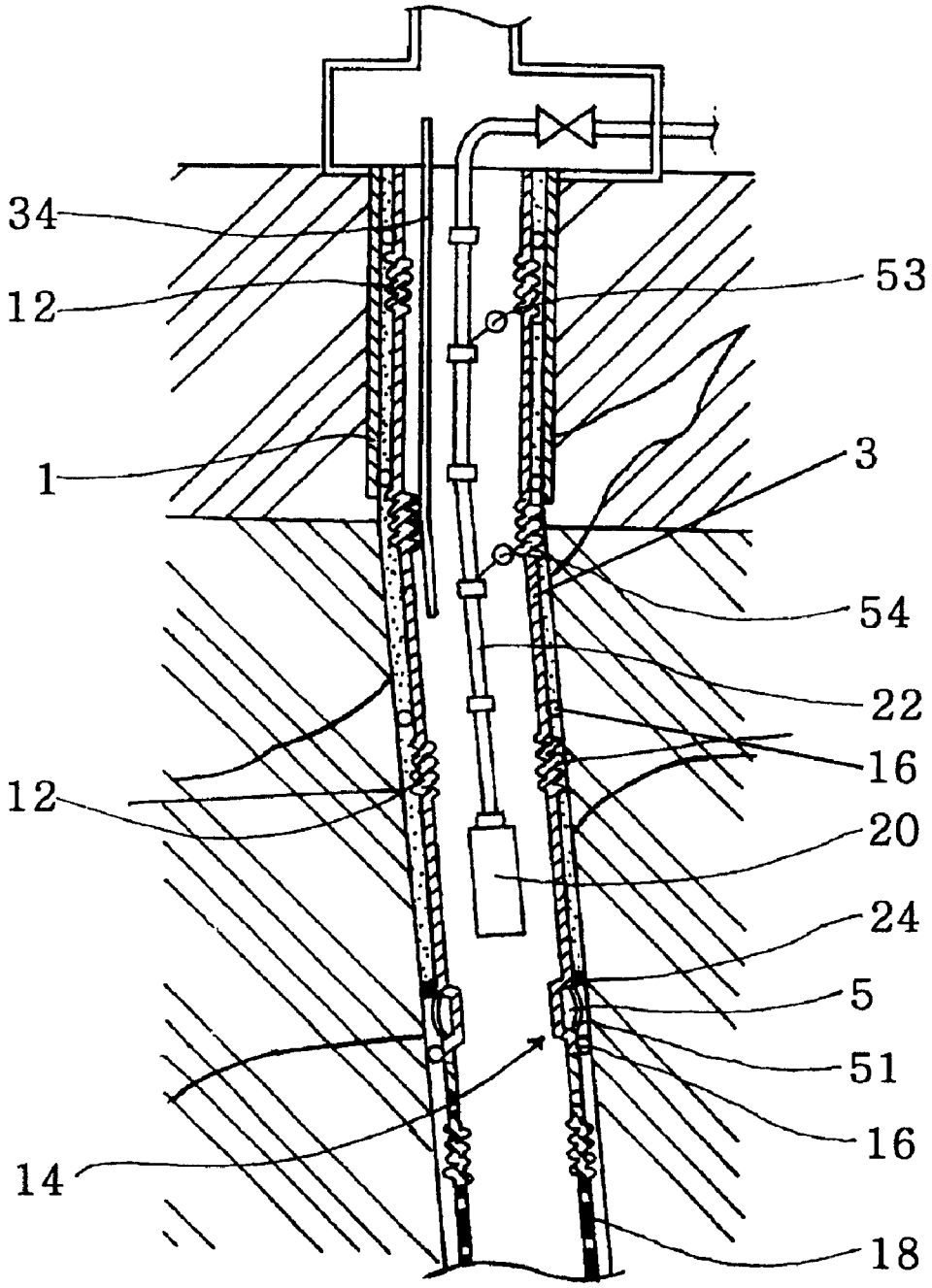
FIG. 2 is a cross-sectional view of the grouting pipe equipment according to a first embodiment of the invention.
Figure 3:
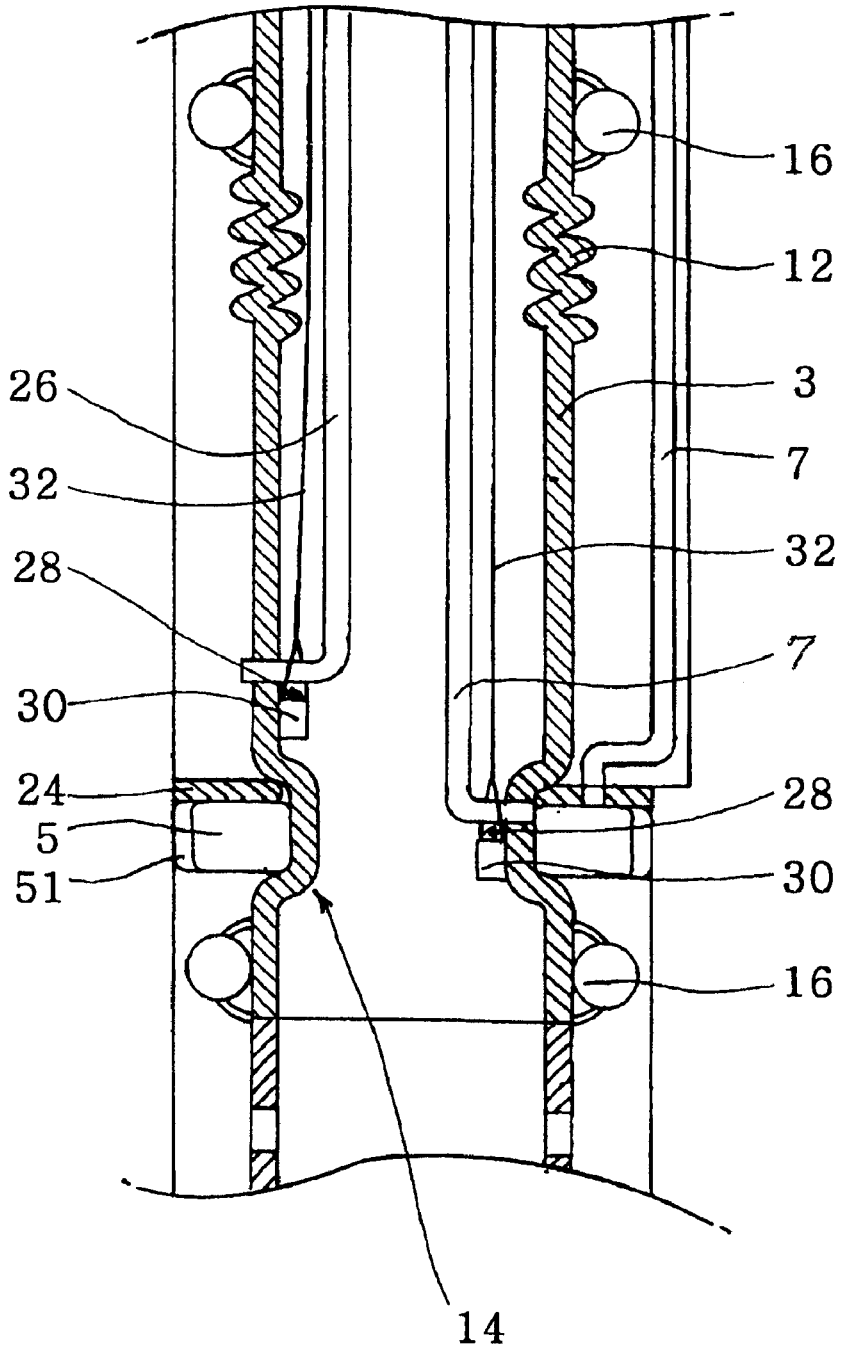
FIG. 3 is a higher magnification cross-sectional view of the incasing of the first embodiment.
Figure 4:
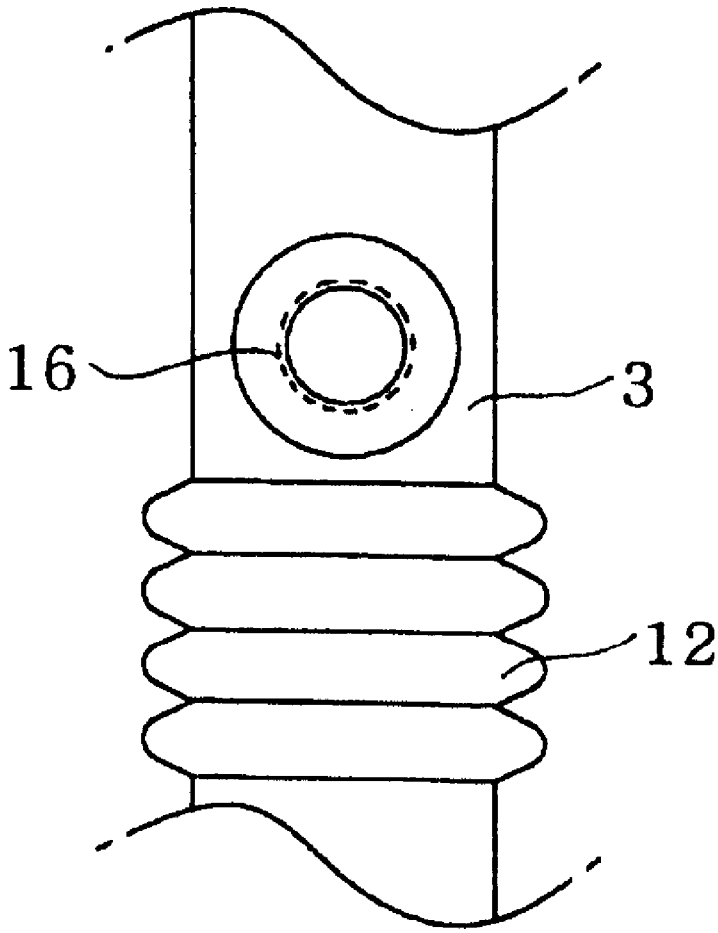
FIG. 4 is a plan view of the incasing of the first embodiment.
Figure 5:
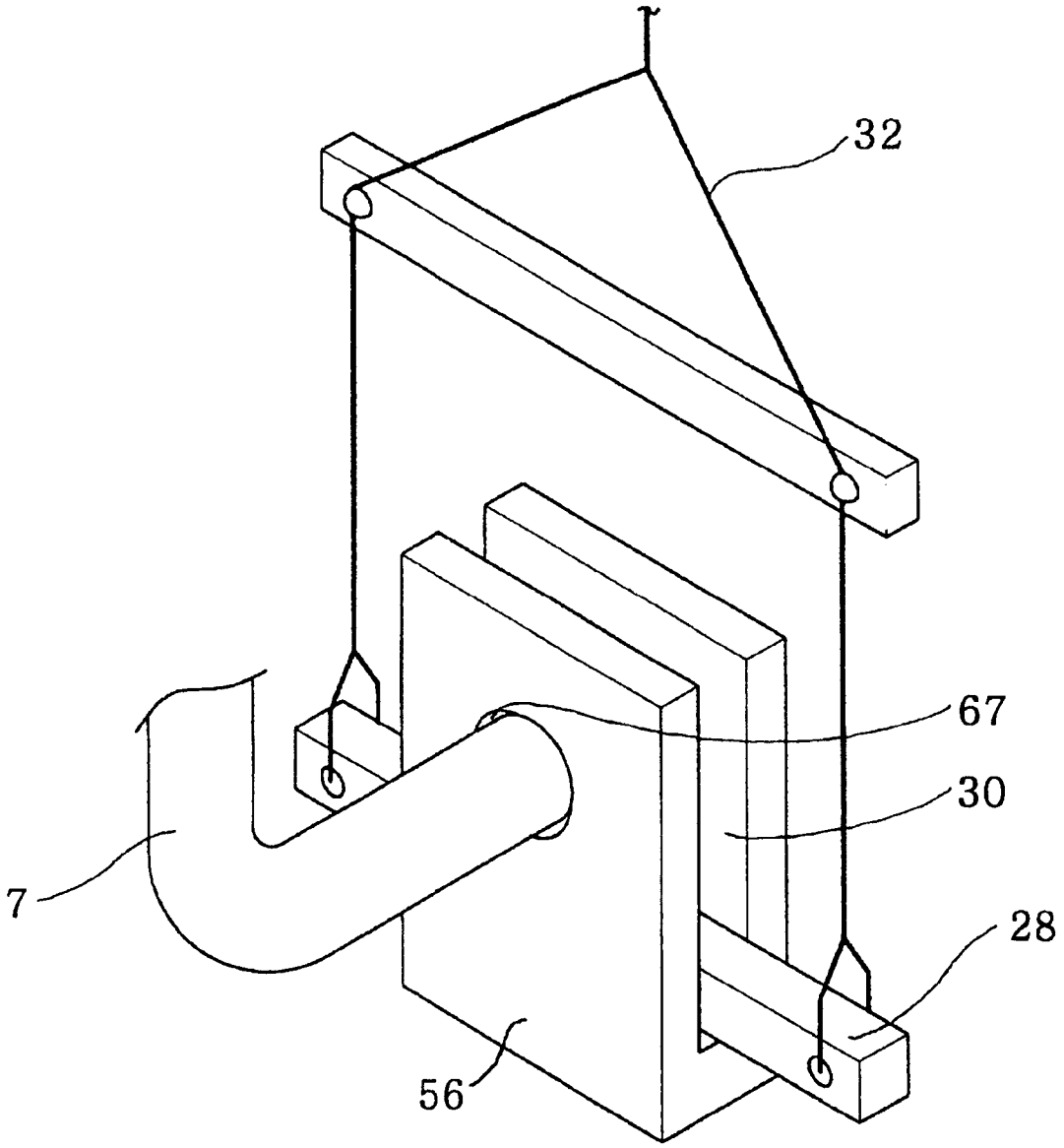
FIG. 5 is a perspective view of the cutting portion of the first embodiment.
Figure 6:
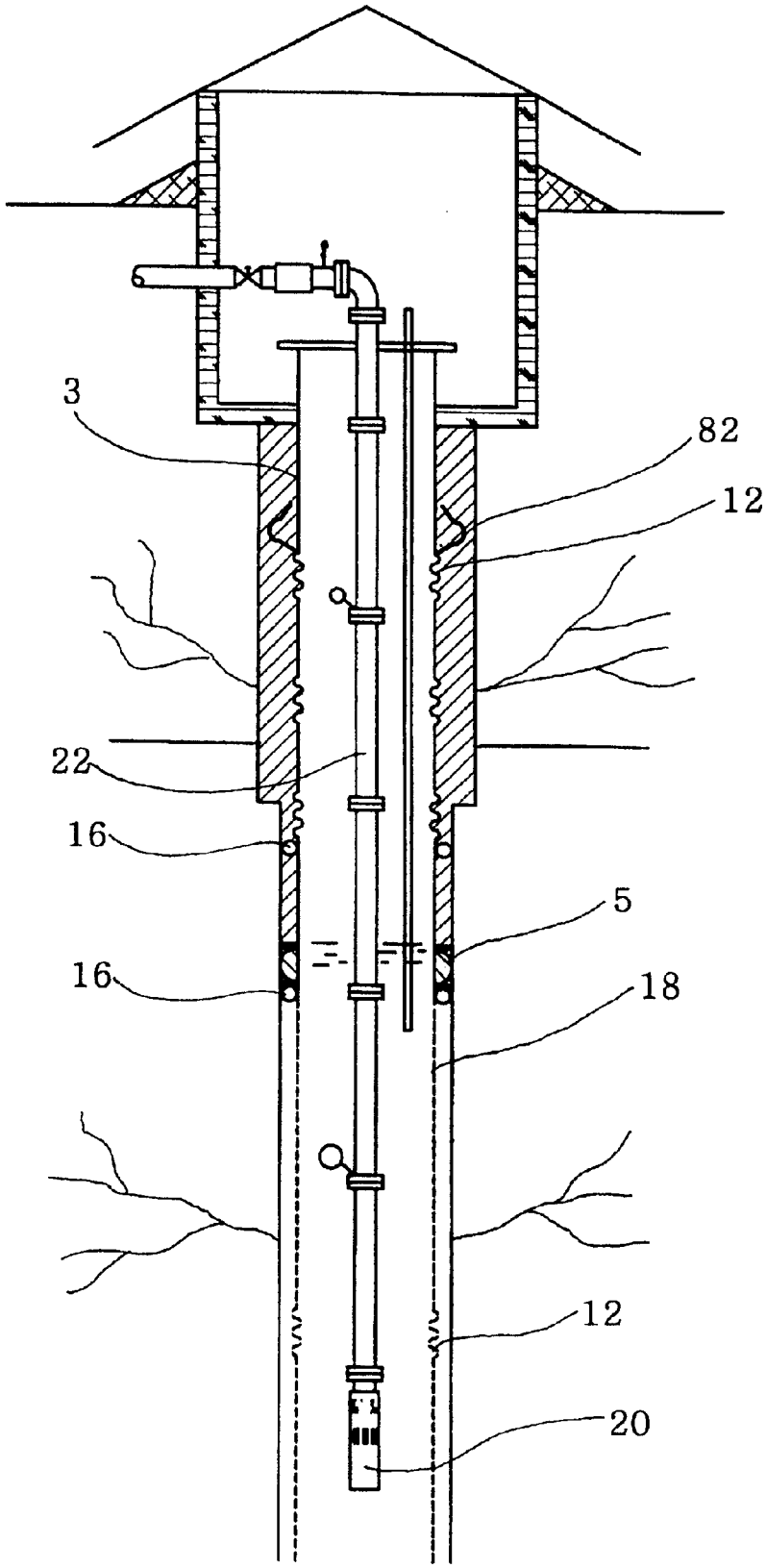
FIG. 6 is a cross-sectional view of the grouting pipe equipment according to a second embodiment of the invention.

FIGS. 2 through 5 disclose a first embodiment for a groundwater well and its associated grouting equipment, which includes:

an outcasing 1 that is installed in a part of the weathered rock layer and the bedrock layer;

an incasing 3 for preventing an influx of contaminated surface water, which is spaced from the inner wall of the bore hole. Incasing 3 also includes corrugation tubes 12 at fixed intervals to allow the incasing to be inserted into a curved bore hole (as shown);

bearings 16 installed at fixed intervals on the exterior of the incasing 3;

a strainer pipe 18 installed under the incasing 3 to filter particulates from the groundwater, and formed with bendable corrugation tubes 12;

a well pump 20 installed inside the incasing 3 to extract the groundwater;

a water-lifting pipe 22 connected to the well pump 20 to transport the groundwater to the ground level;

an expansion tube 5 installed at a section of a reduced diameter 14 of the lower potion of said incasing 3;

a rubber tube 51 installed at an outer circumference of the expansion tube 5 to securely attach the expansion tube 5 to the outer periphery of the incasing 3 before expansion, and to permit for uniform expansion;

a compressed-fluid injection hose 7 installed in the interior or exterior of the incasing 3 and connected to the expansion tube 5 to provide a compressed fluid from the ground level to said expansion tube 5;

a compressed-fluid injection hose cutting mechanism: with reference to FIGS. 3 and 5, a cutting blade 28, a guide 30 for guiding the cutting blade 28, and a cutting portion 56 furnished with a passage hole 67 are attached to the interior of the incasing 3. These structures provide a mechanism for cutting the compressed-fluid injection hose 7 when that hose is installed in the interior of the incasing 3. Passage hole 67 holds the hose 7 steady during the cutting process. Cutting is achieved by pulling on a string 32 which is connected to the cutting blade 28, and which may be pulled by an operator on the ground level;

a soft cover plate 24 installed over the expansion tube 5 to protect the expansion tube 5 from the overlying concrete;

a liquid-grout supply tube 26 installed in the interior of incasing 3 to inject concrete from the ground level to between the incasing 3 and the bore hole;

upper and lower level sensors 53 and 54; and a water gauge pole 34.

B. The Second Embodiment

Figure 7:
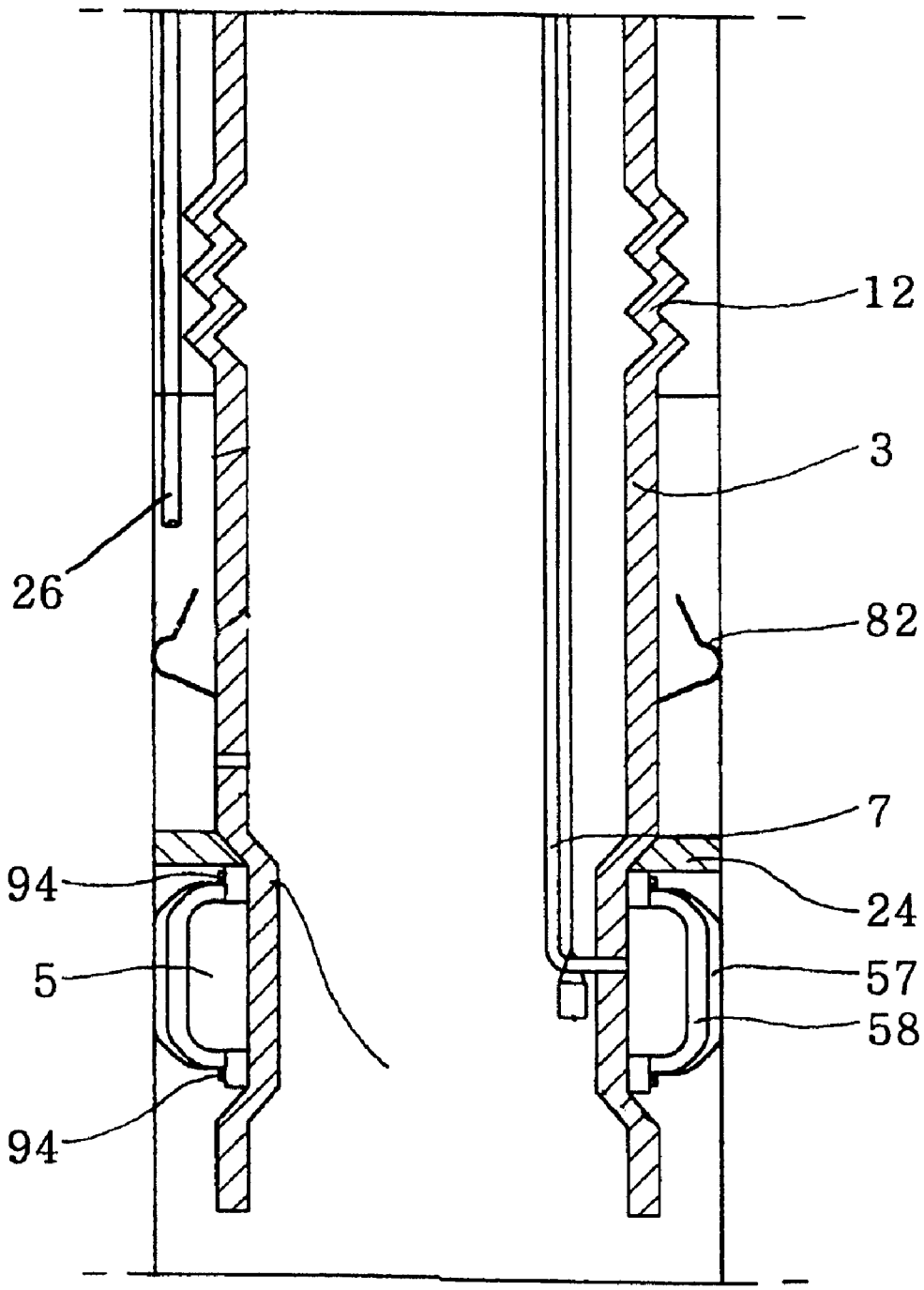
FIG. 7 is a higher magnification cross-sectional view of the incasing of the second embodiment.
Figure 8:
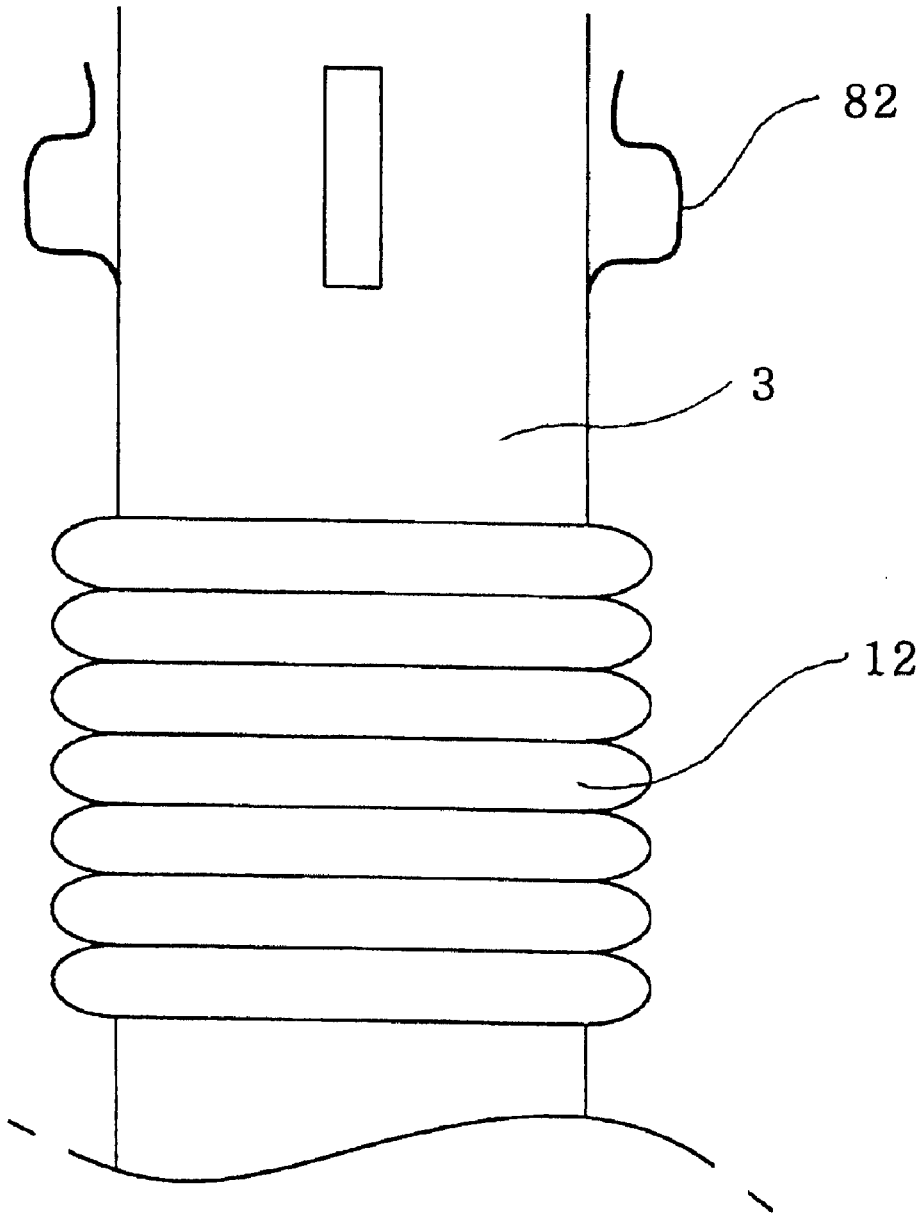
FIG. 8 is a plan view of the incasing of the second embodiment.
Figure 10:
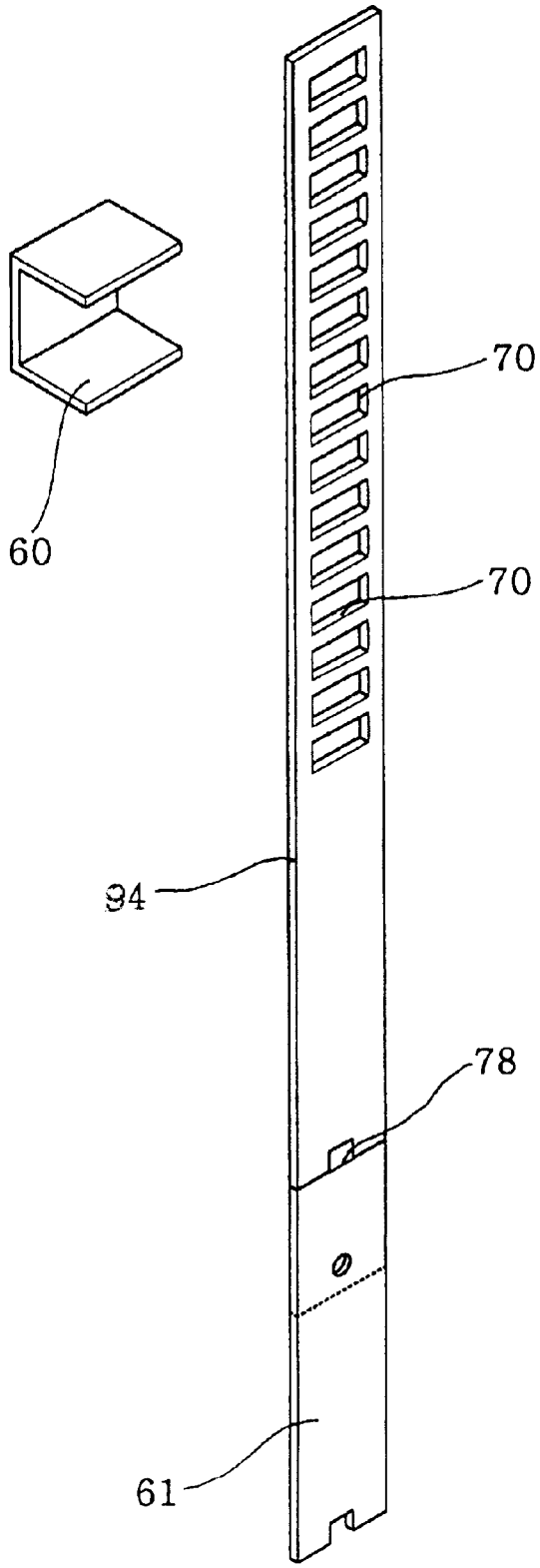
FIG. 10 is a perspective view of the tube band of the second embodiment.

FIGS. 6 through 10 disclose a second embodiment for a groundwater well and its associated grouting equipment. The structure and/or operation of those elements common to the first embodiment are not again summarized. The second embodiment includes:

an outcasing 1;

an incasing 3 with corrugation tubes 12;

a plate spring 82 installed on the exterior of the incasing 3 to maintain a fixed space between the bore hole and the incasing 3, the spring 82 being outwardly circular-shaped and attached only at its lower portion (see FIG. 7);

a strainer pipe 18 with corrugation tubes;

a well pump 20;

a water-lifting pipe 22;

an expansion tube 5;

tube bands 94 for fixing the expansion tube 5 to the exterior of the incasing 3, as shown at FIG. 10. The tube band 94 is formed of a metal belt having several vents 70 on one side, and on the other side, a welded metal bar 61 which has an width equal the metal belt. A protrusion part(s) 78 is formed for insertion into the vents 70 when the periphery of the tube 5 is covered with and coiled around the tube band 94. Any overlapping portion of the metal bar 61 can be fixed to the belt by deforming fixing clip 60.

a protective expansion tube 57 installed at the outer periphery of an internal expansion tube 58 to allow the expansion tube 5 to be expanded uniformly and ensure proper shielding even at the reduced diameter portion 14 of the incasing 3;

a compressed-fluid injection hose 7;

a soft cover plate 24; and a liquid-grout supply tube 26.

Figure 9:
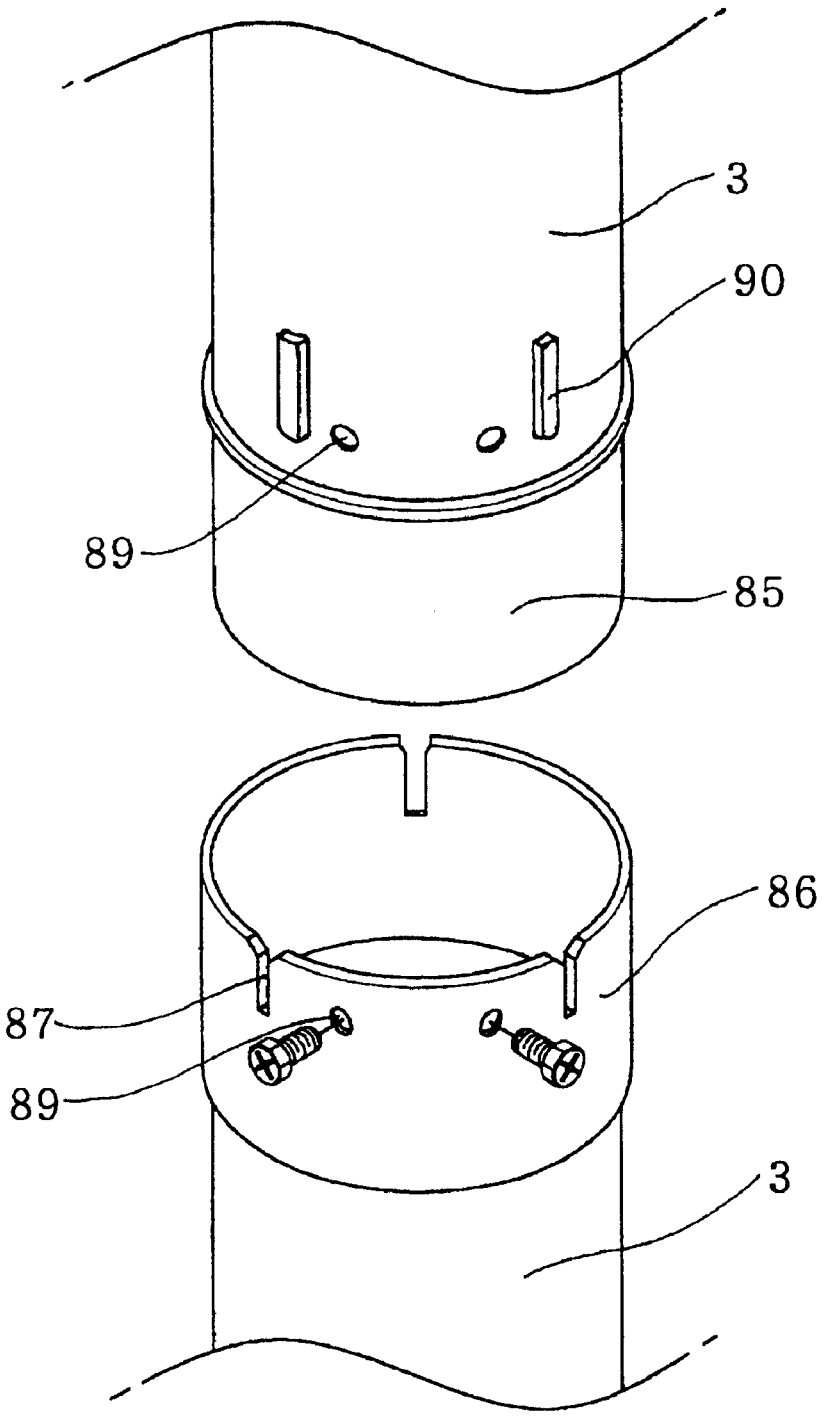
FIG. 9 is a perspective view of the connection portion of the second embodiment.

Also shown, in FIG. 9, is a method for connecting or extending two portions of incasing 3. In this regard, lower connection portion 86 and upper connection portion 85, which appear at the ends of two sections of incasing 3 pipe, are shown. As FIG. 9 shows, lower connection portion 86 has a slightly larger diameter than the corresponding portion of upper connection portion 85. When connected, a number of vertically elongated protrusions 90 on upper portion 85 are fitted into corresponding cut parts 87 appearing on lower portion 86. After connected, the two portions 85 and 86 are bolted at matching bolt holes 89.

C. Methods of Constructing and Using the First and Second Embodiments

1. First Method

When using either the first or second embodiments described above, the first step, in a first method, is to excavate the weathered rock layer and, at least partially, the bedrock layer using a drilling bit of a relatively large diameter. Thereafter, the outcasing 1 is installed on the inner wall of the bore hole to prevent collapse of the bore hole and influx of the contaminated surface water. Next, a drilling bit of a smaller diameter is used to excavate further until groundwater is located. Then, the strainer pipe 18 is inserted and installed in the groundwater, followed by the insertion of the incasing 3 into the upper portion of said strainer pipe 18.

With the help of the bearings 16 (first embodiment) or plate springs 82 (second embodiment), and the corrugation tubes 12, the incasing 3 can be inserted easily even into a curved bore hole without scraping or getting stuck to the bore hole. Additionally, bearings 16 or plate springs 82 position the incasing 3 with a constant annular space from the bore hole.

When the incasing 3 is installed properly, compressed fluid is injected through the compressed-fluid injection hose 7 into the expansion tube 5 mounted at the lower periphery of the incasing 3. This causes the expansion tube 5 to expanded uniformly with the assistance of the rubber tube 51 (first embodiment), or the internal expansion tube 58 in conjunction with the protective expansion tube 57 (second embodiment), such that the expansion tube 5 serves as a shielding plate. Thus, when compressed fluid is injected into said expansion tube 5, the gap between the incasing 3 and the inner wall of the bore hole becomes sealed and the groundwater is thus protected from contamination. Once this first sealing is completed, liquid grout (i.e., concrete) is provided through the liquid-grout supply tube 26 and is cured.

2. Second Method

When using either the first or second embodiments described above, the first step, in a second method, is to excavate the weathered rock layer and, at least partially, the bedrock layer using a drilling bit of a relatively large diameter. Thereafter, the outcasing 1 is installed on the inner wall of the bore hole to preventing collapse of the bore hole and influx of the contaminated surface water. Once the installation of the outcasing 1 is completed, the incasing 3 is installed, and the expansion tube 5 is expanded as discussed above to guarantee a secure shielding.

A bore hole is then excavated to the groundwater nappe in the bedrock layer using a drilling bit of a small diameter. When groundwater is located, liquid grout is injected into the bottom of the annular space exterior to the incasing 3. Again, the expansion tube 5 provides a good seal between the grout and the groundwater.

For either of these two methods, it should be noted that the liquid grout supply tube 26, like the compressed-fluid injection hose 7, can be provided in the interior of incasing 3 (as shown in FIG. 3), or can be provided in the annular space exterior to the incasing 3 (as shown in FIG. 7), if that space is of a sufficient width. Likewise, if the liquid grout supply tube 26 is mounted on the interior, it may be cut using the cutting blade 28, the pulling string 32, and the guide 30 after curing of the concrete is completed, as explained earlier with reference to the compressed fluid injection hose 7.

Using these methods, contaminated surface water is introduced into the well because the liquid concrete is provided through the liquid-grout supply tube 26 in such a way that it pushes the contaminated surface water present in the annular space between the incasing 3 and the bore hole up toward the surface. Additionally, better curing is achieved because "bridging" or incomplete compaction of the concrete does not occur. Further, the soft cover plate 24, possibly including the internal expansion tube 58 and the protective expansion tube 57 (second embodiment), protects the expansion tube 5 from damage when the liquid concrete is injected. When the construction is completed as described above, the water-lifting pipe 22 and the well pump 20 can be installed inside the incasing 3, thereby allowing pumping of groundwater.

D. Third Embodiment

Figure 11:
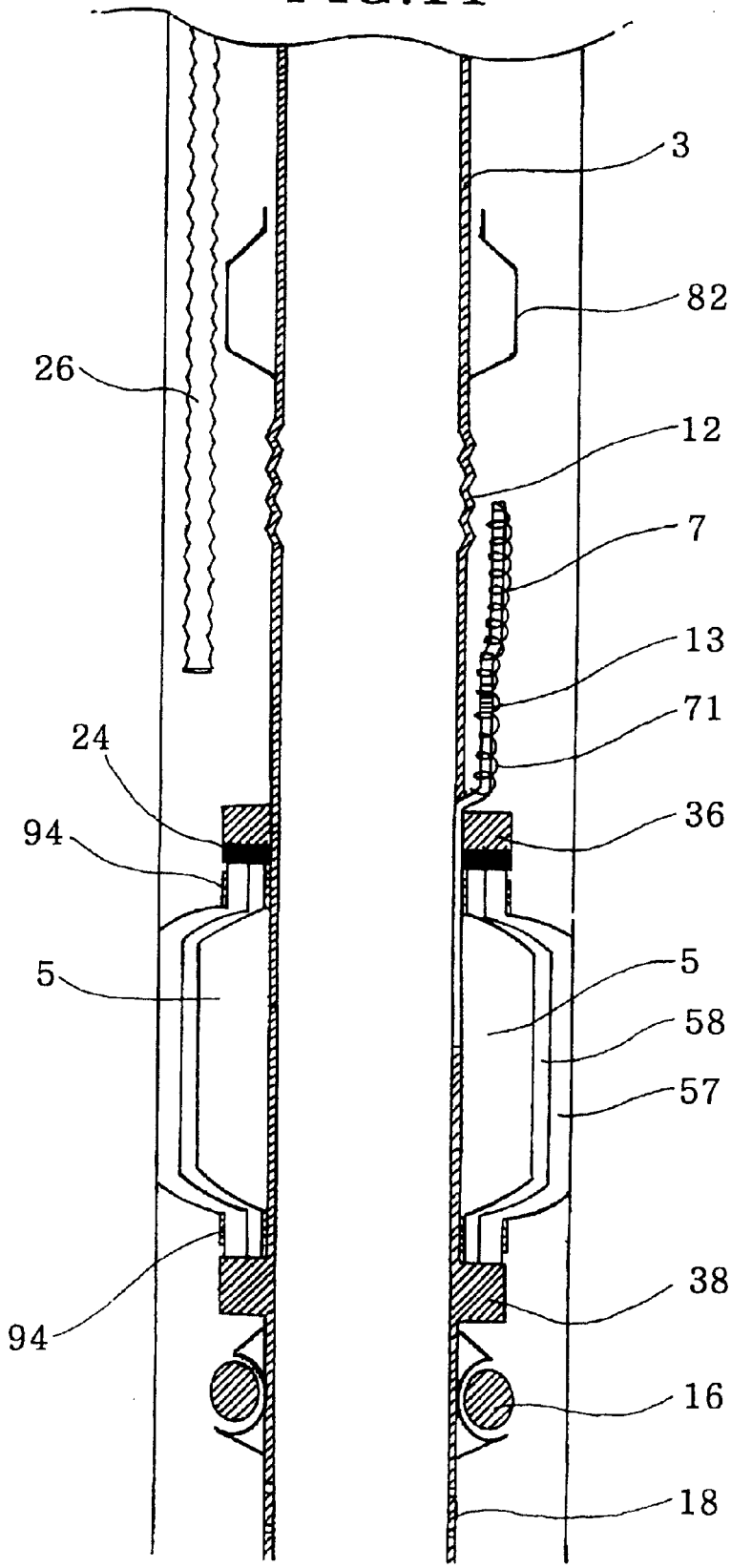
FIG. 11 is a cross-sectional view of the grouting pipe equipment according to a third embodiment of the invention.
Figure 12:
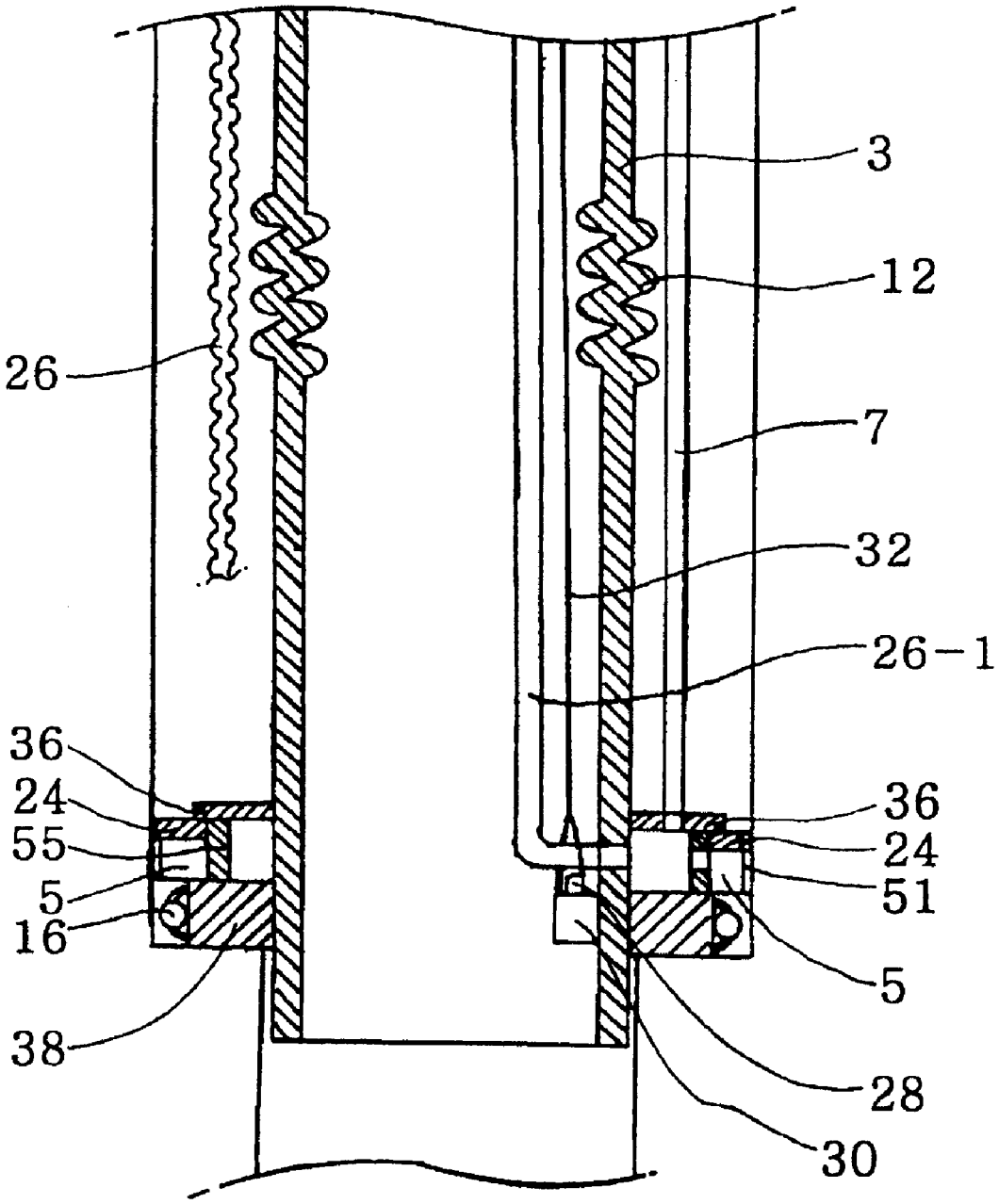
FIG. 12 is a higher magnification cross-sectional view of the incasing of the third embodiment.
Figure 13:
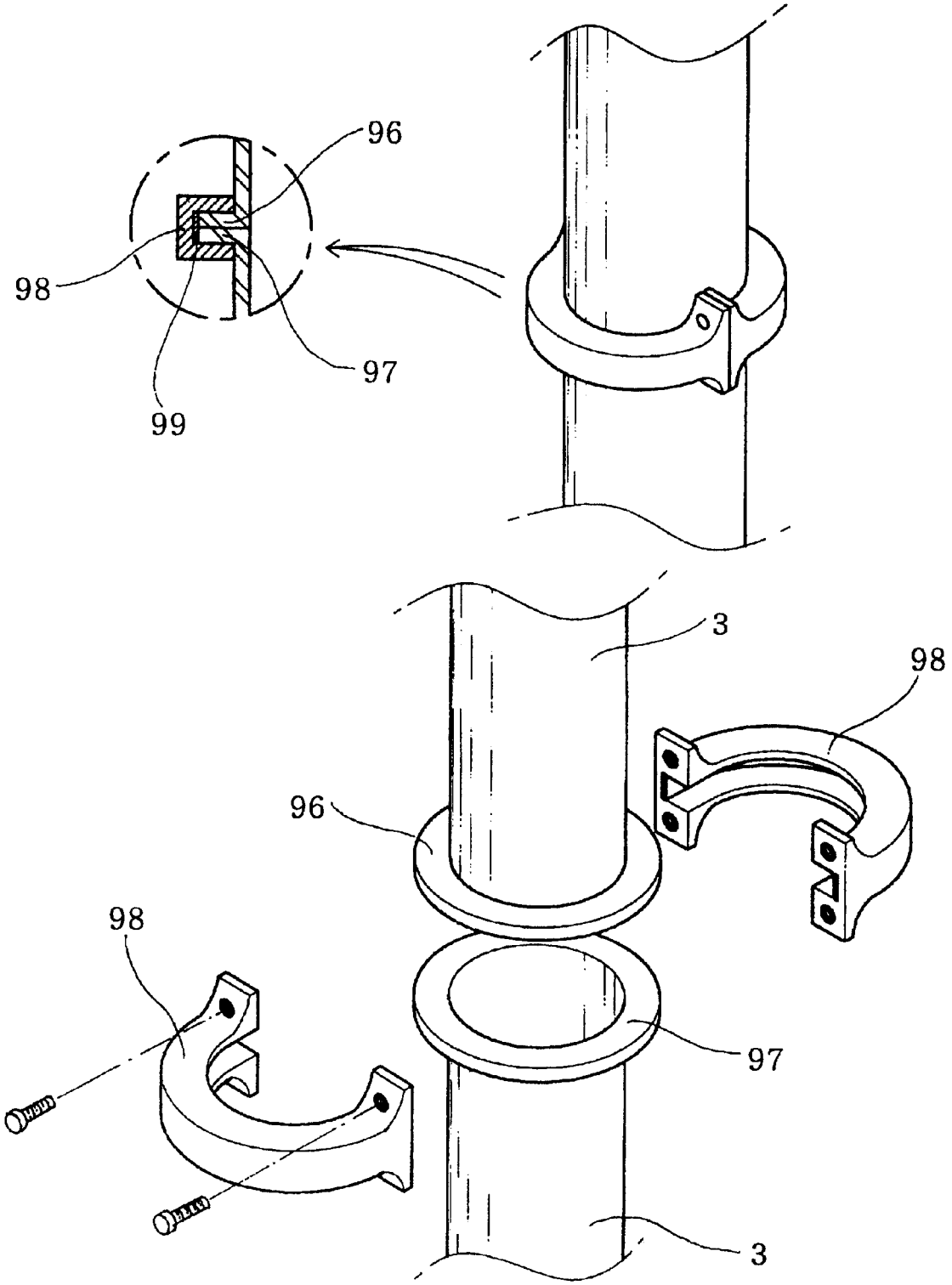
FIG. 13 is a perspective and cross-sectional view of the connection portions of the incasing of the third embodiment.

FIGS. 11 through 13 disclose a third embodiment for a groundwater well and its associated grouting equipment. Referring to FIG. 12, the lower part of the incasing 3 is provided with a shielding pipe 55 having a given length. The upper and lower part of the pipe 55 are respectively located in proximity to an upper protective circular board 36 and a lower protective circular board 38, both of which have a larger diameter than that of the shielding pipe 55. The outer periphery of the shielding pipe 55 is provided with an expansion tube 5. The expansion tube 5 is protected by the upper protective circular board 36 and the lower protective circular board 38, which act to prevent damage to expansion tube 5 when the incasing pipe is subsequently inserted into the bore hole. In addition, the outer periphery of the lower protective circular board 38 is provided with bearings 16, which serves as a guide when the incasing 3 is inserted. Again, plate springs 82 (see FIG. 11) keep a constant distance between the incasing 3 and the internal wall of the bore hole, so that thickness of the grouted concrete can be kept constant even in a curved bore hole. As in the first embodiment, a soft cover plate 24 is provided between the upper protective circular board 36 and the expansion tube 5, and a rubber band 51 is provided outside the expansion tube 5 to protect the expansion tube 5 and to effectuate uniform expansion thereof. Likewise, as in the first embodiment, a compressed-fluid injection hose 7 is connected to the expansion tube 5 exterior to the incasing 3, and a soft liquid grout supply tube 26 is provided exterior to the incasing 3.

As another variation, as shown in FIG. 11, the compressed-fluid injection hose 7 is connected to the expansion tube 5 via outside of the incasing 3. According to this variation, the intake of the expansion tube 5 is made by incising the body of the incasing 3 partially in a vertical direction, by inserting the compressed-fluid injection hose 7 into the incision part, and by welding the hose 7 in place. This procedure is facilitated when the incasing 3 and the injection hose 7 are made of the same material. A connector 13 connects the welded portion of the compressed-fluid injection hose 7 to a longer free portion of the hose. The compressed-fluid injection hose 7 is protected against impact by being coiled on its exterior with a coil spring 71.

E. Method of Constructing and Using the Third Embodiment

When using the third embodiment described above, the first step is to excavate the weathered rock layer and, at least partially, the bedrock layer using a drilling bit of a relatively large diameter. Thereafter, the outcasing 1 is installed on the inner wall of the bore hole to preventing collapse of the bore hole and influx of the contaminated surface water. Next, a drilling bit of a smaller diameter is used to excavate further until groundwater is located. Then, the strainer pipe 18 is inserted and installed in the groundwater, followed by the insertion of the incasing 3 into the upper portion of said strainer pipe 18.

The incasing 3, complete with the shielding pipe 55 and other related structures, is inserted to a depth where the lower protective circular board 38 rests on the junction formed at the interface of the large diameter bore hole and the smaller diameter bore hole. Then compressed fluid is injected to the expansion tube 5 through the injection hose 7 so that the expansion tube 5 expands as previously summarized.

In this embodiment, because the difference in diameter between the shielding pipe 55 and the bore hole is relatively small, the expansion tube 5 need only expand slightly to form the seal, thus lessening the chance of damaging the expansion tube 5. When concrete is injected through the liquid-grout supply tube 26, the load of the concrete is dispersed by the upper protective circular board 36 such that the load imposed on the expansion tube 5 is reduced, further protecting the expansion tube 5 from damage. The concrete wall cured between the incasing 3 and the bore hole is formed to be sufficiently thick to obtain a complete sealing effect.

In a variation on this technique, cement, urethane, epoxy resin, or other suitable materials may be used as the compressed fluid that is injected into the expansion tube 5. This allows the well to be primarily sealed by fast curing of the compressed fluid. This provided a stable load for the subsequently injected concrete, which act secondarily to seal the well.

FIG. 13 discloses another method for connecting or extending the incasing 3. This variation employs an upper circumference ring 96 and a lower circumference ring 97 positioned at respective ends of two sections of incasing 3. When the two sections of incasing are joined at the rings 96 and 97, a packing 99 may be placed over them, and then the joined structure set within semi circular couplers 98, each having a "C" shaped section. The two couplers 98 may then be bolted together as shown.

When the construction is completed as described above, the water-lifting pipe 22 and the well pump 20 can be installed inside the incasing 3, thereby allowing pumping of groundwater.

F. Fourth Embodiment

FIGS. 14 through 17 disclose a fourth embodiment for a groundwater well and its associated grouting equipment. The fourth embodiment has a similar structure to the second embodiment, and the reader is thus directed to the discussion of the second embodiment for a fuller discussion of the components that are common to both.

The fourth embodiment includes an outcasing 1, an incasing 3, a plate spring 82, an expansion tube 5, a compressed fluid injection hose 7, a cover plate 24, and a liquid-grout supply tube 26, as in the second embodiment. In one difference between the two embodiments, a screw junction part 63 is provided to allow for extension of the incasing 3. Screw junction part 63 is formed in a round screw shape to allow the junction of pieces the incasing 3 in an easy manner.

Figure 14:
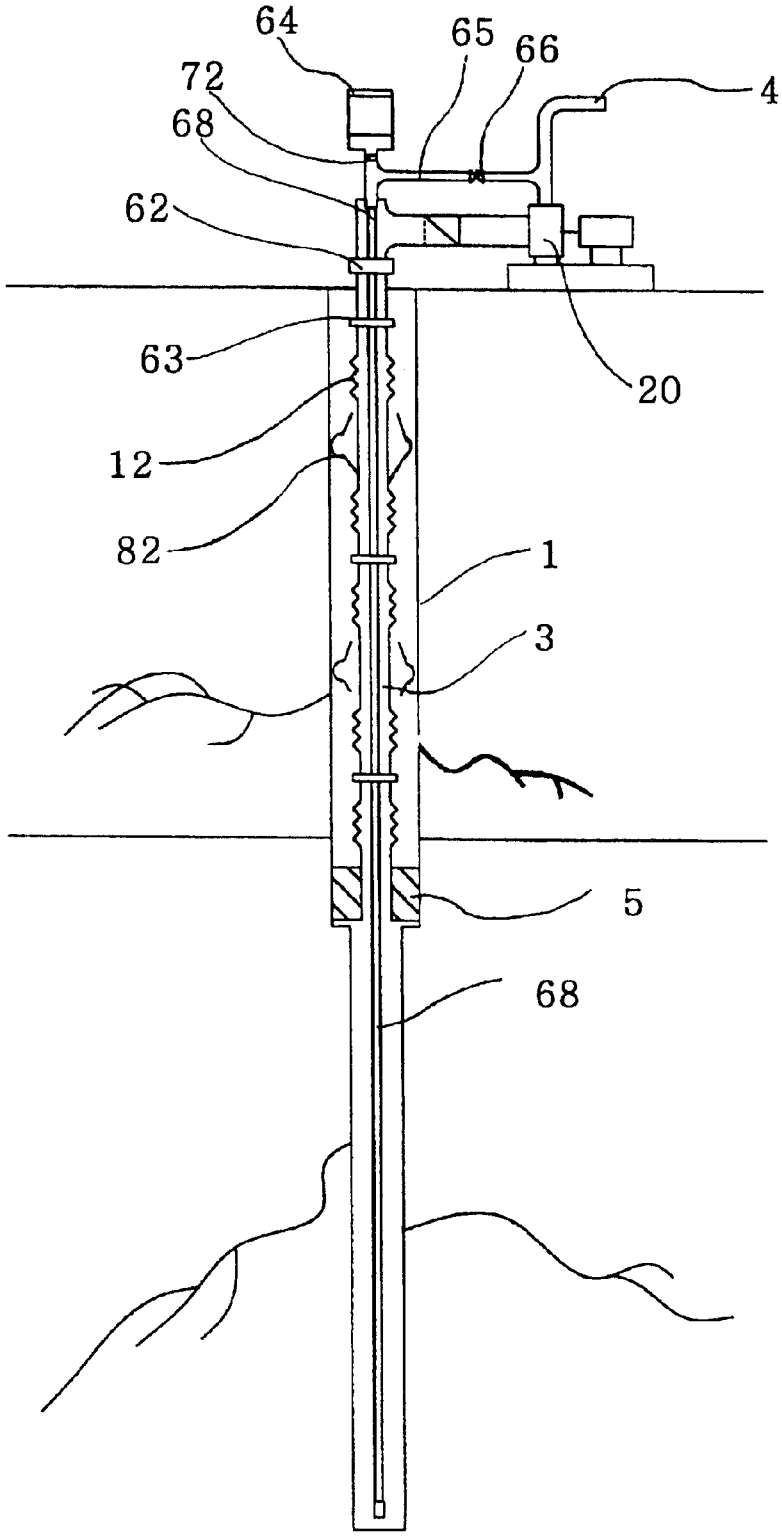
FIG. 14 is a cross-sectional view of the grouting pipe equipment according to a fourth embodiment of the invention.
Figure 15:
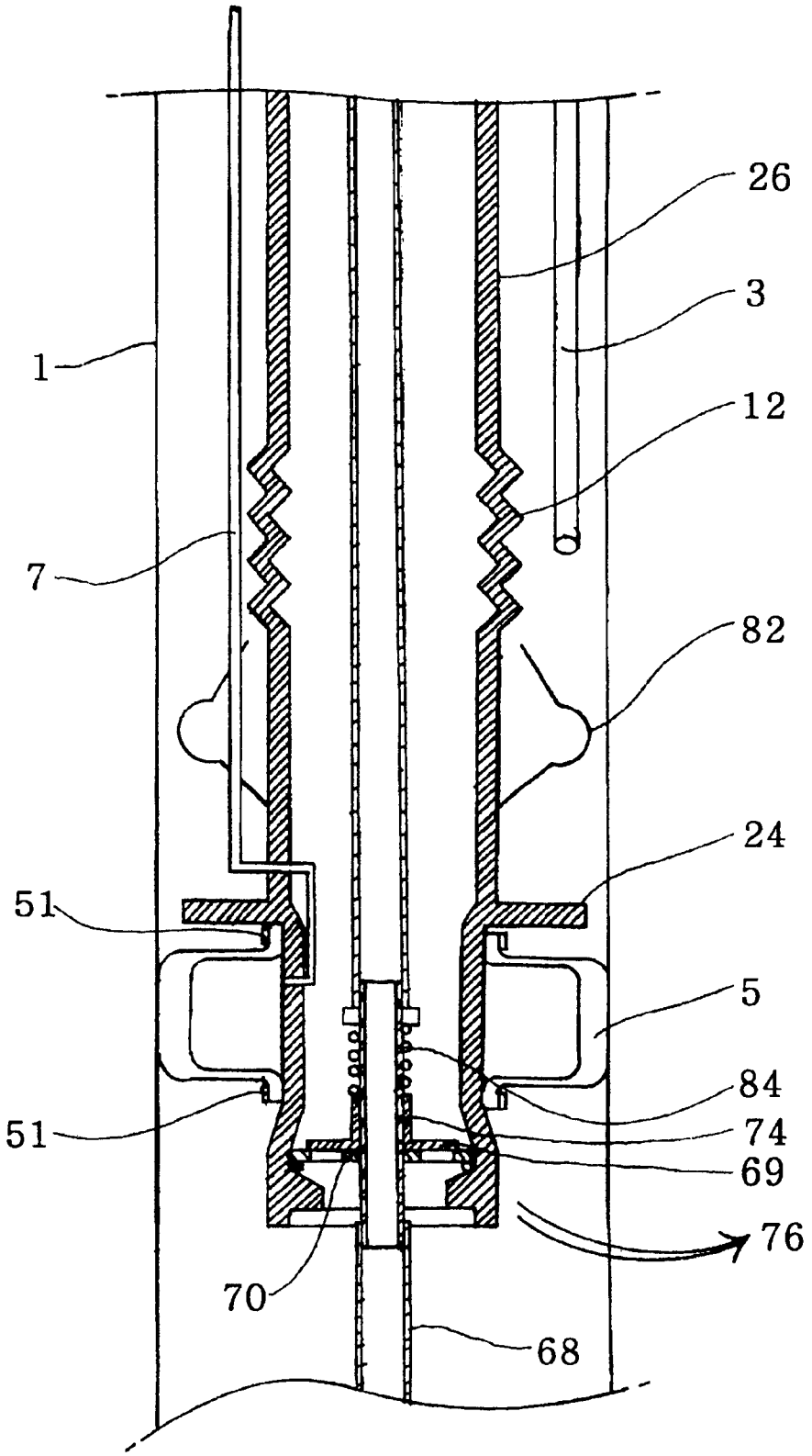
FIG. 15 is a cross-sectional view showing the installation of an expansion tube of the fourth embodiment.

Referring to FIG. 14, the water pump at the ground level can be connected directly to the well equipment by applying a connection accessory device 62 to the uppermost end of the incasing 3. A female screw is provided in the upper end of the connection accessory device 62 and a pressure equalizer tube 68 is provided in the incasing 3. If a hose of different material is used, a pendulum 59 can be hung on the lowermost part of the pressure equalizer tube 68 to assist in set up. A filter barrel 64 having a check valve 72 for the pressure equalizer tube 68 is provided above the tube 68 to prevent contaminants from flowing into the well if air flows into the pressure equalizer tube 68. A contra-injection tube 65 with a valve 66 for adjusting fluid amount is also provided as shown and is connected to the output of the water pump.

Figure 16:
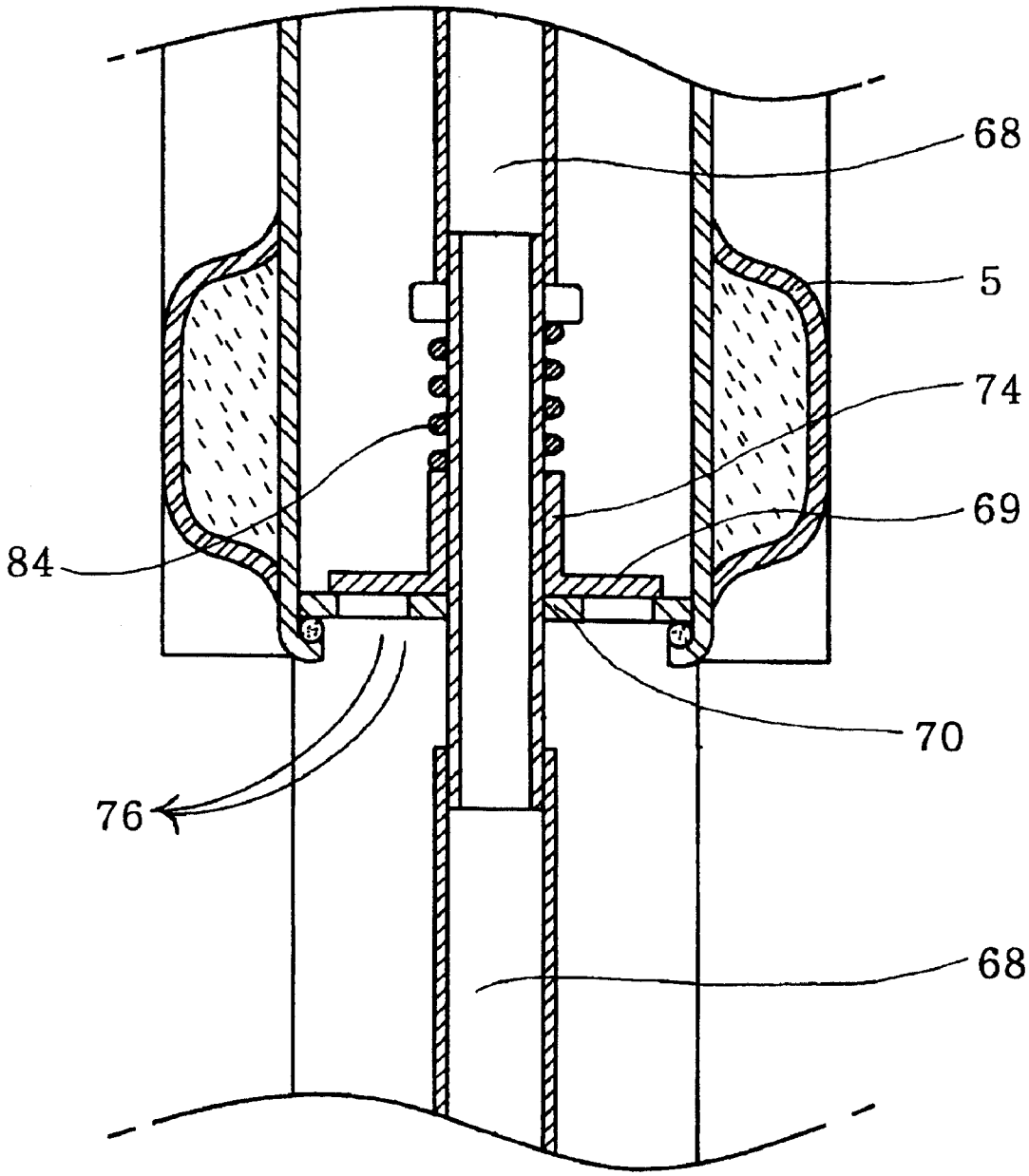
FIG. 16 is a cross-sectional view of the check valve of the fourth embodiment.
Figure 17:
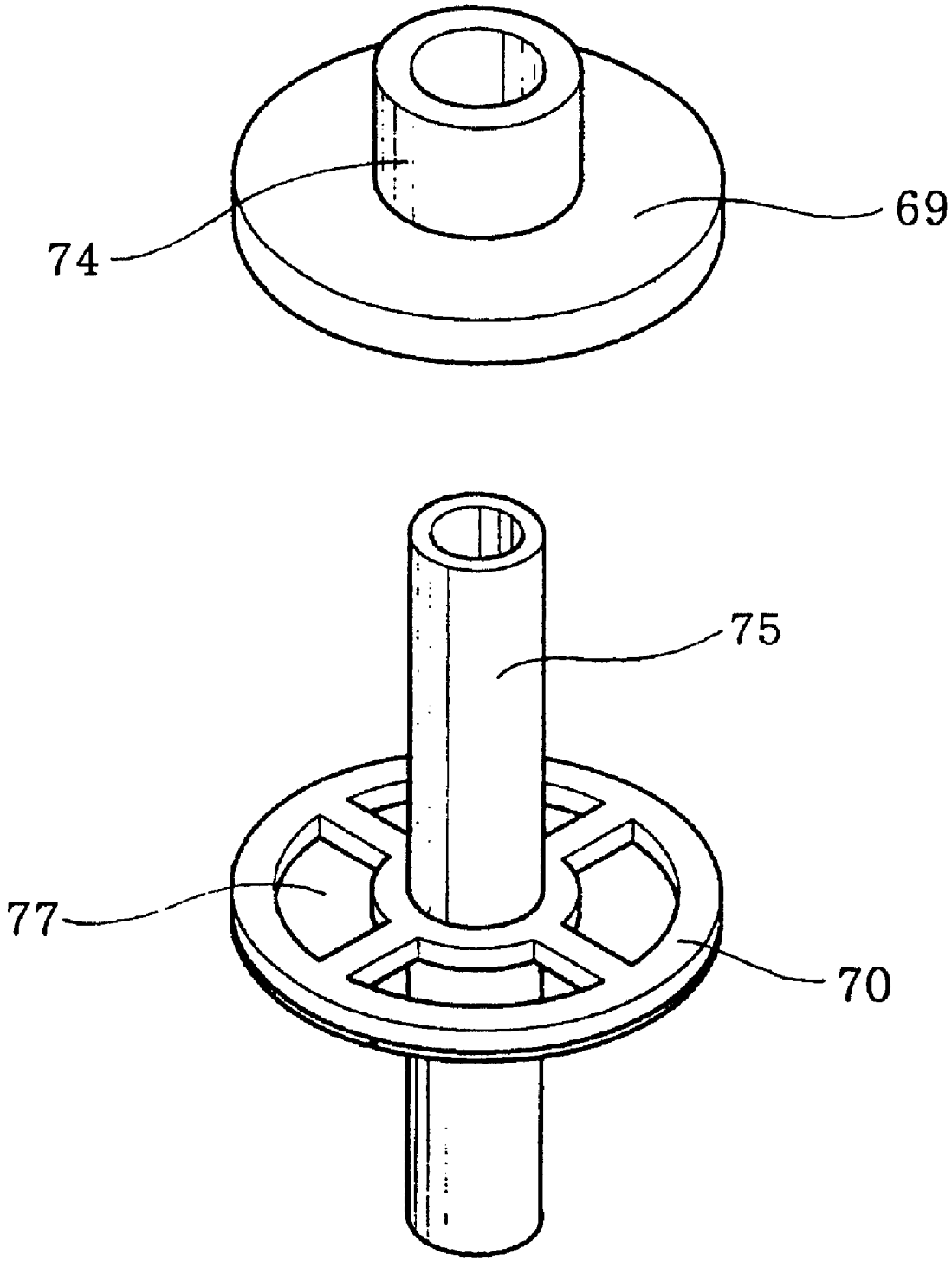
FIG. 17 is a perspective view of the check valve of the fourth embodiment.

FIG. 16 shows the lower part of the well, including the check valve 76, which is shown in FIG. 17. The check valve 76 includes a hollow sliding pole 75, a check valve seat 70, and openings 77, through which groundwater passes to the top of the well. The check valve is seated at the end of the incasing 3, which is bent inwardly at its end to form a lip for this purpose. Packing may also be applied between the check valve 76 and bent lip as is shown in FIG. 16. The hollow sliding pole is connected to the pressure equalizer tube 68. A plate shaped check valve circular board 69 with a cylindrical guide 74 covers the check valve seat 70 so that board 69 and the upper surface of the check valve seat 21 are in close contact. Cylindrical guide 74 is stressed by a spring 84. As will be explained in more detail in the next section, the check valve 76 helps to prevent the water level in the well from dropping excessively.

G. Method of Constructing and Using the Fourth Embodiment

When using the fourth embodiment, the well is first drilled and grouted using the techniques earlier described.

Thereafter, the pump pipe is connected to the connection accessory device 62 at the upper end of the incasing 3. Next, the check valve 72 and valve 66 for adjusting the fluid amount through the contra-injection tube 65 are adjusted.

When water is filled into the impeller casing of well pump 20, and when valve 66 is closed, groundwater is raised from a natural water level in the incasing 3, while the water level in pressure compensation equalizer tube 68 is lowered from the natural water level to prevent excessive negative pressure in the incasing 3.

If the natural water level is low, air may flow into the well, and water pumping may be negatively affected because air is drawn into the well pump 20. To address this problem, some of the groundwater from the well pump 20 is injected into the lower part of the well through the pressure compensation equalizer tube 68 via contra-injection tube 65. Thereafter, valve 66 on the contra-injection tube 65 is closed to allow air to flow continuously into the well to prevent air from congesting in the well pump 20. Thus, a balance can be achieved between groundwater flowing into the well from the nappe and groundwater flowing into the lower part of the well through the contra-injection tube 65, so that water pumping may be suitably and quickly controlled.

When the well pump 20 is stopped, the water level in the well will tend to go down. The check valve 76 acts to prevent the water level from going down at an excessive rate which would affect the ability of the well pump 20 when it is later again turned on. Check valve 76 holds groundwater in the incasing 3 because the check valve seat 70 and the check valve circular board 69 are in contact because of the weight of the pressure compensation equalizer tube 68 and the pendulum, which is transferred to the check value circular board 69 through spring 84 when the pump stops. In short, keeping the incasing 3 filled with groundwater makes the pumping operation easier to start when the pump again operates.

If the check valve 76 has a problem, the check valve seat 70 and the check valve circular board 69 can easily be drawn out the well by disassembling the upper part of the pipe connection accessory and by pulling up the pressure compensation equalizer tube 68, making maintenance work convenient.

H. Fifth Embodiment

Figure 18:
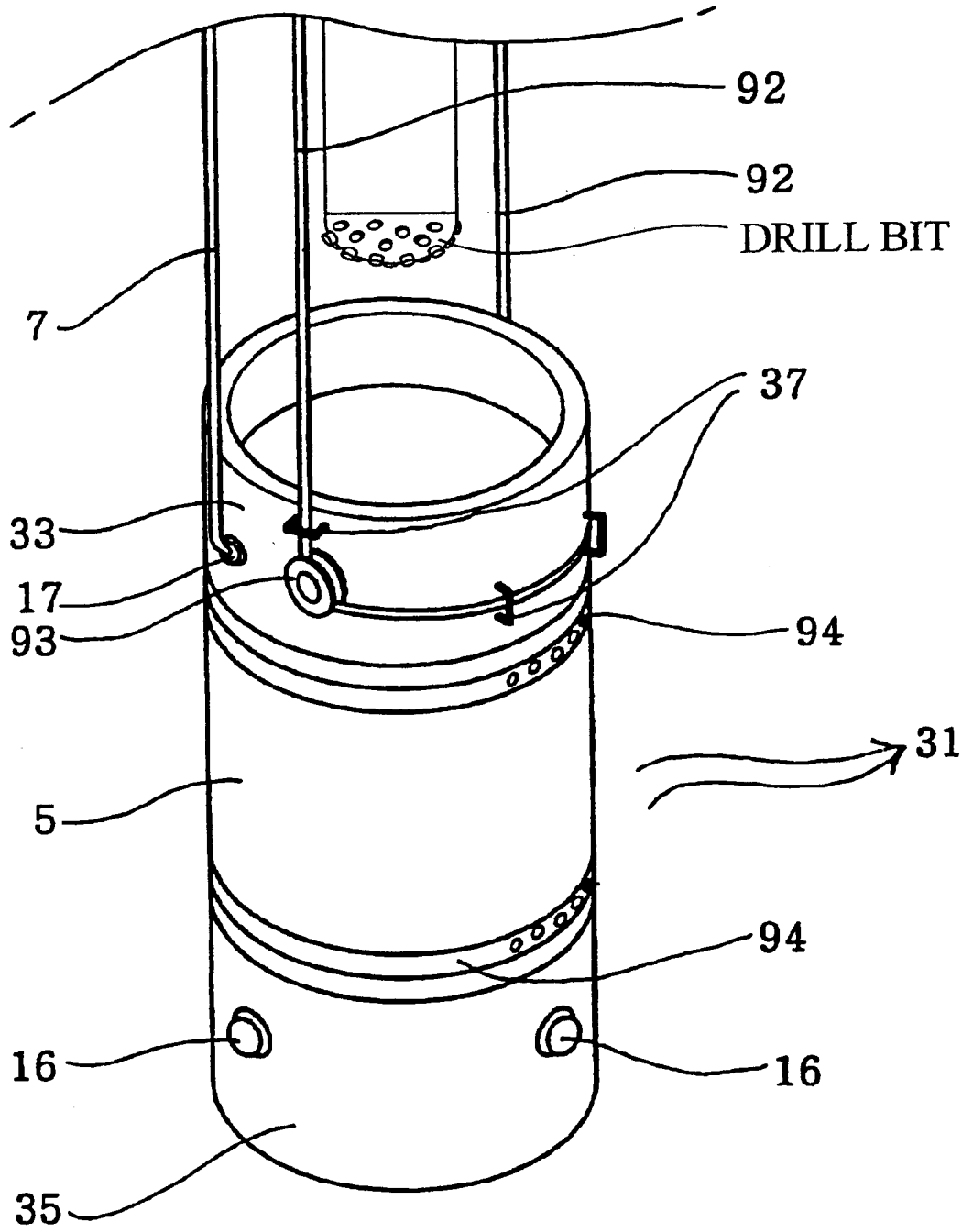
FIG. 18 is a plan view of a well mounted with a drilling bit guiding device and an expansion tube according to a fifth embodiment of the invention.
Figure 19:
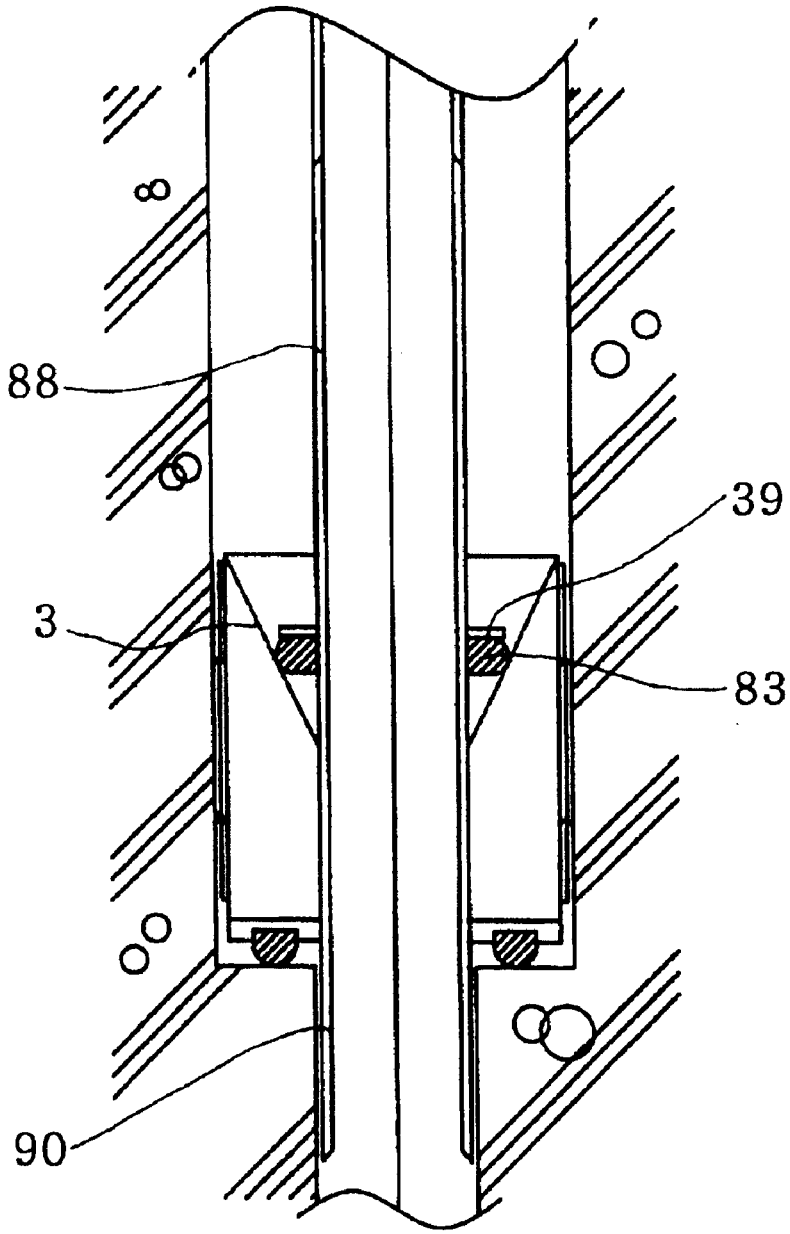
FIG. 19 is a cross-sectional view of the equipment shown in FIG. 18.

FIGS. 18 and 19 disclose a fifth embodiment, more specifically a guiding device 31 for a drilling bit that also includes many of the grouting structure mentioned earlier. As will be explained subsequently, this device allows for a well to be partially excavated (e.g., using a large diameter drill bit), grouted, and then excavation can continue (e.g., using a smaller diameter drill bit). Element numerals designating structures earlier mentioned are not further discussed for simplicity.

FIG. 18 shows a perspective view of guiding device 31 for the drilling bit, while FIG. 19 provides a cross sectional view. The inside diameter of the upper portion 33 of guiding device 31 in equal to that of the incasing 3 to simplify their connection. The inside diameter decreases steadily from the top of the guiding device 31, resulting in an inverted cone shaped upper part. The-lower portion 35 of guiding device 31 has the same inside diameter through its entire height, resulting in the body of guiding device 31 having a funnel shaped section, as shown in FIG. 19. To assist in guiding a drilling bit through the guiding device 31, the inside diameter of the lower portion 35 of guiding device 31 is formed a little larger than the diameter of the drilling bit.

Hole 17 acts as an input for compressed fluid injection hose 7 and is formed in the upper portion of guiding device 33. Expansion tube 5 is positioned on the exterior of guiding device 31 and is fixed by a tube band 94. The expansion tube 5 comprises an outside soft expansion tube and an inside hard expansion tube integrally formed so that a watertight seal can be obtained even when the inside wall of the groundwater well is rough. This construction also allows for the formation of a steady expansion force for the tube 5. Bearings 16, formed on the lower portion 35 of the guiding device 31, facilitate the insertion of the guiding device 31 by providing a space between the device and the well wall, and protect the expansion tube 5 during insertion. Pulleys 93 are provided respectively at opposite sides of the upper portion 33 of guiding device 31 so that a wire rope 92 can be affixed to manipulate the device 31 from outside of the well. Guidance rings 37 prevent the wire rope 92 from moving off the pulleys 93.

I. Method of Constructing and Using the Fifth Embodiment

The fifth embodiment is used in operation as follows. First, a primary excavation using a drill bit of a large diameter is used to reach a given depth in the bedrock. Guiding device 31 is connected to an incasing 3. Wire rope 92 is inserted to the pulleys 93 and the device is lowered down to the bottom of the bore hole. As mentioned earlier, the diameter of the upper portion 33 of the guiding device 31 is the same as the outer diameter of the incasing 3, thus making it simple to assemble or weld the two together.

After insertion into the well, compressed fluid is injected into the expansion tube 5 to cause it to expand and create a seal against the well wall. Through this expansion, the centers of the bore hole and the guiding device 31 are made to coincide. Additionally, this expansion prevents inflow of contaminated surface water and helps to hold the incasing 3 and guiding device 31 steady from vibrations caused subsequent excavation. Thereafter, a bore hole of small diameter is dug. The funnel shaped body of guiding device 31 acts to place the drilling bit in a central position within the well. A cylindrical portion 90 acts to guide the small diameter drilling bit at early stages in the excavation process.

If a groundwater nappe is located during the drilling process, the wire rope 92 is removed from the guiding device by pulling it through the pulleys 93. Thereafter, liquid grout (i.e., concrete) is injected into the annular space and is cured. If a groundwater nappe is not found, pressure is relieved in the expansion tube 5 and the incasing 3 and guiding device 31 are drawn out of the well by pulling on both sides of the wire rope 92.

If the diameter of the incasing 3 has a smaller diameter than that of the guiding device 31, the guiding device 31 is first centered by the expansion tube 5, and then the incasing is inserted. To ensure that the grout fills the annular space between the incasing and the well wall without leakage, a round plate shaped ring 39 is welded to the end of the grouting pipe to which is connected a soft O-ring packing 83 (see FIG. 19). When the incasing 3 is inserted, the O-ring packing 83 contacts the guiding device 31 somewhere near the middle of its sloped (i.e., cone shaped) surface. The weight of the incasing compresses O-ring 83 to prevent leakage of the grout.

J. Conclusion

The disclosed embodiments offer the following advantages. First, an incasing can be inserted to a desired depth without being stuck even in bent bore holes. Second, reliability of the grouting is improved. Third, the expansion tube allows grouting to be performed while preventing contamination of the groundwater and blockage of its passage into the well. Fourth, the disclosed techniques have applicability to wells already exploited and wells under exploration. Fifth, the incasing can be used as the water pumping pipe for wells of small diameter, and in a manner that prevents the influx of contaminated surface water, and which makes grouting relatively simple. Sixth, the centering mechanisms disclosed herein allow for the formation of a water-proof grouted wall having no gaps. Seventh, excavation to the groundwater nappe is made possible without inflow of the contaminated surface water through unification of the grouting pipe and the body of the guiding device. Eighth, the incasing and the guiding device can be-easily drawn out of a well that has not tapped into a groundwater nappe.

What is claimed is:

1. A system for grouting a well containing a bore hole with a bore hole wall, comprising:

an incasing capable of being placed within a bore hole to create an annular space between the bore hole wall and the incasing; and an expandable tube positioned on exterior of the incasing and capable of expansion to create a seal at portion of the annular space between the incasing and the bore hole wall; and a cover plate installed on the exterior of the incasing and over the expandable tube to protect the expandable tube from grout.

2. The system of claim 1, wherein the incasing further includes bendable corrugations to allow the incasing to be inserted in non-linear bore holes.

3. The system of claim 1, wherein the expandable tube is positioned on the incasing at a portion of the incasing having a reduced diameter.

4. The system of claim 1, further including bearings positioned on the exterior of the incasing.

5. The system of claim 1, wherein the expandable tube is affixed to the incasing by a band.

6. The system of claim 1, wherein the expandable tube comprises an alp internal expansion tube and a protective tube positioned exterior to the internal expansion tube.

7. The system of claim 1, further comprising a shielding pipe located between the expandable tube and the incasing.

8. The system of claim 1, wherein the shielding pipe has an upper and lower edge, and further comprising circular boards attached to the exterior of the incasing, wherein the exterior boards connect to the upper and lower edges of the shielding pipe.

9. The system of claim 1, further comprising a plurality of springs on the exterior of the incasing to assist in centering the incasing within the bore hole wall.

10. The system of claim 1, wherein the incasing consists of a plurality of connected incasing portions.

11. The system of claim 1, further comprising a grout supply tube for supplying liquid grout to the annular space above the seal formed by the expandable tube.

12. The system of claim 11, wherein the grout supply tube is located in the interior of the incasing, and further comprising a tube cutter mounted to the interior of the incasing for cutting the grout supply tube.

13. The system of claim 1, further comprising an injection hose for supplying a material to the expandable tube to promote expansion of the tube.

14. The system of claim 13, wherein the injection hose is located in the interior of the incasing, and further comprising a hose cutter mounted to the interior of the incasing for cutting the injection hose.

15. The system of claim 13, wherein the injection hose is made of the same material as the incasing.

16. The system of claim 15, wherein the injection hose is fastened along a portion of the incasing and is capable of supplying the material through cuts made in the incasing.

17. The system of claim 1, further comprising a strainer pipe connected to the incasing, the strainer pipe containing bendable corrugations to allow for the insertion into non-linear bore holes.

18. The system of claim 1, further comprising a well output to dispense fluid from the well and a pressure equalizer tube, wherein the pressure equalizer tube is capable of receiving a portion of the fluid and air to regulate the pressure within the well.

19. The system of claim 18, further comprising a filter in communication with the pressure equalization tube to prevent airborne contaminants from entering the well through the pressure equalization tube.

20. The system of claim 18, further comprising a contra-injection tube connected to the well output, wherein the contra-injection tube is controllable by a valve to control the amount of fluid received by the pressure equalization tube.

21. The system of claim 18, further comprising a check valve connected to the interior of the incasing, the check valve for controlling fluid flow in the well, wherein the check valve is controllable in part by the weight of the pressure equalization tube.

22. A drilling bit guiding device for guiding a drill bit of a first diameter within a bore hole wall of a second diameter, wherein the first diameter is smaller than the second diameter, comprising:

a cylindrical body with a constant external third diameter, wherein the third diameter is larger than the first diameter but smaller than the second diameter, the body containing a funnel narrowing from the third diameter to accompany the drill bit of the first diameter, wherein the body is connectable to an incasing;

wherein the incasing contains a circular ring at an end of the incasing that is connected to an o-ring, and wherein the incasing is connectable to the body through the o-ring; and an expandable tube positioned on exterior of the body around the third diameter and capable of expansion to create a seal at portion of an annular space between the body and the bore hole wall.

23. The guiding device of claim 22, further including bearings positioned on the exterior of the body.

24. The guiding device of claim 22, further comprising an injection hose for supplying a material to the expandable tube to promote expansion of the tube.

25. The guiding device of claim 22, wherein the incasing has a fourth diameter between the first diameter and the third diameter.

26. A method for forming a structure for a well, the well containing a first bore hole wall of a first diameter, comprising:

installing an incasing into the bore hole, the incasing containing an expandable tube positioned on exterior of the incasing, the incasing defining an annular space with respect to the bore hole wall;

expanding the expandable tube to create a seal at a portion of the annular space between the incasing and the bore hole wall;

drilling with a drill bit of a second diameter smaller than the first diameter to reach a nappe; and centering the drill bit by passing the drill bit through guiding device connected to the expanded tube.

27. The method of claim 26, further comprising filling the portion of the annular space above the expanded tube with grout.

28. The method of claim 26, further comprising installing an outcasing against the bore hole wall prior to installing the incasing.

29. The method of claim 26, wherein the guiding device contains a funnel.

30. The method of claim 26, further comprising filling the portion of the annular space above the expanded tube with grout.

* * * * *

UNITED STATES PATENT AND TRADEMARK OFFICE

CERTIFICATE OF CORRECTION

PATENT NO. : 6,698,976 B1
DATED : March 2, 2004
INVENTOR(S) : Heuy Nam Cho

It is certified that error appears in the above-identified patent and that said Letters Patent is hereby corrected as shown below:

Column 11,
Line 41, please delete “an alp internal” and insert therefor -- an internal --.

Signed and Sealed this

Fifteenth Day of June, 2004

JON W. DUDAS
*Acting Director of the United States Patent and Trademark Office*